US005209374A

United States Patent [19]

Seidl-Lichthardt

[11] Patent Number: 5,209,374

[45] Date of Patent: May 11, 1993

[54] LABEL DISPENSER FOR SELF-ADHESIVE LABELS ARRANGED ON SEPARATE SHEETS

[76] Inventor: Johanna Seidl-Lichthardt, Hugo von Hofmannsthal-strasse 2, 8000 Munchen 81, Fed. Rep. of Germany

[21] Appl. No.: 845,047

[22] Filed: Mar. 3, 1992

[30] Foreign Application Priority Data

Mar. 9, 1991 [DE] Fed. Rep. of Germany ..... 4107669

[51] Int. Cl.[5] ..... B65H 5/28

[52] U.S. Cl. ..... 221/73; 221/259; 156/443; 156/542; 156/584

[58] Field of Search ..... 221/22, 23, 73, 259; 156/443, 542, 584, 249, DIG. 33

[56] References Cited

U.S. PATENT DOCUMENTS

| | | | |
|---|---|---|---|
| 3,941,278 | 3/1976 | Oglander et al. | 221/73 |
| 4,872,593 | 10/1989 | Behringer | 221/259 X |
| 5,000,815 | 3/1991 | Hanna | 156/DIG. 33 X |
| 5,065,896 | 11/1991 | Jurgich | 221/73 |

*Primary Examiner*—Robert P. Olszewski
*Assistant Examiner*—Dean A. Reichard
*Attorney, Agent, or Firm*—Merchant, Gould, Smith, Edell, Welter & Schmidt

[57] ABSTRACT

A label dispenser for self-adhesive labels arranged on separate sheets, with a stack holder for the sheets, is described which is distinguished by the following features:

a sheet feed device (8) for the sheets;

a deflector device (deflector—or pivotal roller 2), which, in the feed direction of each sheet, is pivotable immediately in front of the bending edge (1) into the feed path;

a drive for a draw-off device, which pulls the sheet in contact with it at an angle to the feed direction; and and a control for the sheet feed device, the deflector device and the draw-off device such that each sheet is firstly advanced with its leading edge over the bending edge (1); that the deflector device is then actuated and subsequently the draw-off device feeds the sheet transferred to it, taking with it the first label or the first row of labels beyond the bending edge until the trailing label edge is located substantially in the vicinity of the bending edge (1), then interrupts the further withdrawal of the label or all of the labels of the first row and continues the feeding in steps.

14 Claims, 3 Drawing Sheets

LABEL DISPENSER FOR SELF-ADHESIVE LABELS ARRANGED ON SEPARATE SHEETS

The invention relates to a label dispenser for self-adhesive labels arranged on separate sheets, with a stack holder for the sheets.

Self adhesive labels are often used for marking or identifying a plurality of different wares or objects. The labels are generally also previously provided with a printing or are prepared for a supplementary inscription and are adhered to a corresponding backing material. They are easily releasable from the backing material, which serves as a protection for the adhesive surfaces against contamination, and can then be applied to the corresponding objects. In the case of some applications, the labels are wound on rolls for the purpose of simple handling, in other cases they are produced and used in sheets. On a sheet of, for example, DIN A 4 format, there are then provided, according to size, very few or very many labels. Since, in particular, for example for large mail order houses or warehouses, a large number of objects have to be provided with corresponding labels, it is necessary in the interest of fast work throughput to make the labels available quickly and continuously for manual labelling, when automatic labelling is not possible. For this purpose, corresponding dispensers for labels in roll form have been developed, which not only supply the labels sequentially to the operator but, also, make them available partially released from their backing material, so that they can be completely released by gripping and applied to the objects.

From German Auslegeschrift 1,143,143, there is known "Apparatus for the Removal of the Backing Paper from Adhesive Labels". In this label dispenser for labels arranged on separate sheets, the sheets for dispensing labels are engaged directly before the bending edge with a pliers-like tool are drawn around this bending edge by releasing and advancing the labels.

From European Published Application 345,468, there is known a "Label Dispenser for Franking Machines" in which the individual labels are drawn from a stack holder by a sheet feed device formed as rollers and are then further advanced between two rollers. This operation is initiated by pressure on a control plate of the stack holder. These known label dispensers also have, however, the abovedescribed disadvantages and are relatively unsuitable for the above-mentioned applications.

The invention is therefore based on the problem of providing an automatic dispenser for self-adhesive labels arranged on sheets, having a sheet feed device which, with a simple construction, substantially reduces the dead time for the feeding of each new label sheet and is comparable in this respect to a dispenser for roller labels.

The solution of this problem is set forth in patent claim 1.

According to the invention, therefore, a device is provided which is distinguished from the state of the art by

- a sheet feeling device for the sheets which draws them from the stack holder and feeds them sequentially, with the labels outermost, over a support in a feed direction towards a bending edge;
- a deflector device (deflector or swing-roller 2), which is movable immediately beyond the bending edge, as viewed in the sheet feed direction, from a position above the label, taking with it that part of the sheet located beyond the bending edge, downwardly until contact of the sheet with a draw-off device (draw-off roller 5);
- a drive for the draw-off device, which draws off the sheet located in contact with it at an angle to the said feed direction;
- and a control for the sheet feed device, the deflector device and the draw-off device such that each sheet lying on the support is firstly fed out with its leading edge so far beyond the bending edge that the leading edge of the first label or the first row of labels is located in the vicinity of the bending edge, that the deflector device is then actuated and finally the draw-off device feeds further out the sheet transferred to it, taking the first label or the first row of labels over the bending edge until the trailing label edge is located substantially in the vicinity of the bending edge, then interrupts further stripping until removal of the label or all of the labels of the first row and then continues the feeding and the drawing of each sheet in steps, corresponding to the first label or the first row of labels, as far as the last label or the last row of labels of each sheet.

Advantageous embodiments of the inventive concept are set forth in the subclaims.

In this description and in the patent claims, for easier understanding, it is assumed that the sheets lie in the stack holder with the upper sides parallel to a horizontal plane and are fed parallel to this plane to the bending edge. The expressions "upper", "lower", "behind" and "in front" thus refer to a label dispenser which is oriented as stated and shown. Also, the most frequently occurring case is described below, in which successive rows of self-adhesive labels are located on a sheet—for example of DIN A4 size—and each row of labels has a plurality of individual labels. The description and the claims should, however, also hold true for sheet labels in which each sheet has in fact several rows of labels, but each row for example has only one label. Also, the stack holder of the label dispenser is not necessarily horizontally oriented; an inclination can be definitely worthwhile for various reasons.

The label dispenser can, in particular, be provided with a hold-down device, which acts from above onto the label sheet presently located on the support in the region before the bending edge. The hold-down device is in that case advantageously movably held and can be pressed onto a label sheet with such a downward pressure that it prevents slipping of the rear edge thereof. The hold-down device can, furthermore, be arranged so as to be lowerable together with the pivotal roller.

A control by means of sensors is advantageous. A sensor can, e.g., be arranged beyond the bending edge, as viewed in the direction of feed of the sheets. It can furthermore be located in the vicinity of the furthest left or right label of each row located on the label sheets and, in the absence of the said left or right label, can emit a pulse to the control for initiating operation of the sheet feed device and to notify the control of the next arrival of a new left or right label.

The drive elements for the sheet feed device and/or the draw-off roller are not described in detail with reference to a drawing. Electrical stepping motors are preferably employed here, which can be exactly controlled by computer in dependence of the sizes of the sheets and of the labels and also in dependence on sensor signals from a microprocessor, and can make possible an optimal positioning of the labels for manual removal. The control technology can be implemented utilizing the above-mentioned constructional elements in a conventional manner and, also, can have an input console or interface to a computer, by which the parameters required for the control can be transmitted to the control.

The control can, alternatively, also be implemented mechanically and more particularly by rotation of a shaft of the draw-off roller in such a manner that, by rotation in one direction, the sheet is withdrawn by the sheet feed device from a supply stack and advanced to the output region of the label dispenser and, by rotation in the opposite direction, the deflector roller is pivoted downwardly, taking with it the leading edge of the advanced sheet.

Advantageously, by the rotary movement of the shaft effecting the sheet advance, the deflector roller is moved into its position located above the bending edge.

The surface of the draw-off roller is advantageously so formed, by machining or coating, that the friction with the advanced label sheets is increased.

A particularly secure advance is obtained if the ratio of the advance produced by the sheet feeding device relative to the pull produced by the draw-off device (draw-off roller) amounts to about 99:100.

The spacing between the bending edge and the point of contact between the draw-off roller and the pivotal roller lying on it is, advantageously, at the most as large as the smallest adjustable value for the advance of the sheet over the bending edge, upon which the control for the pivotal movement of the pivotal roller is initiated.

Further details, features and advantages are given in the following description of exemplary embodiments with reference to the drawings in which.

Figure 1:
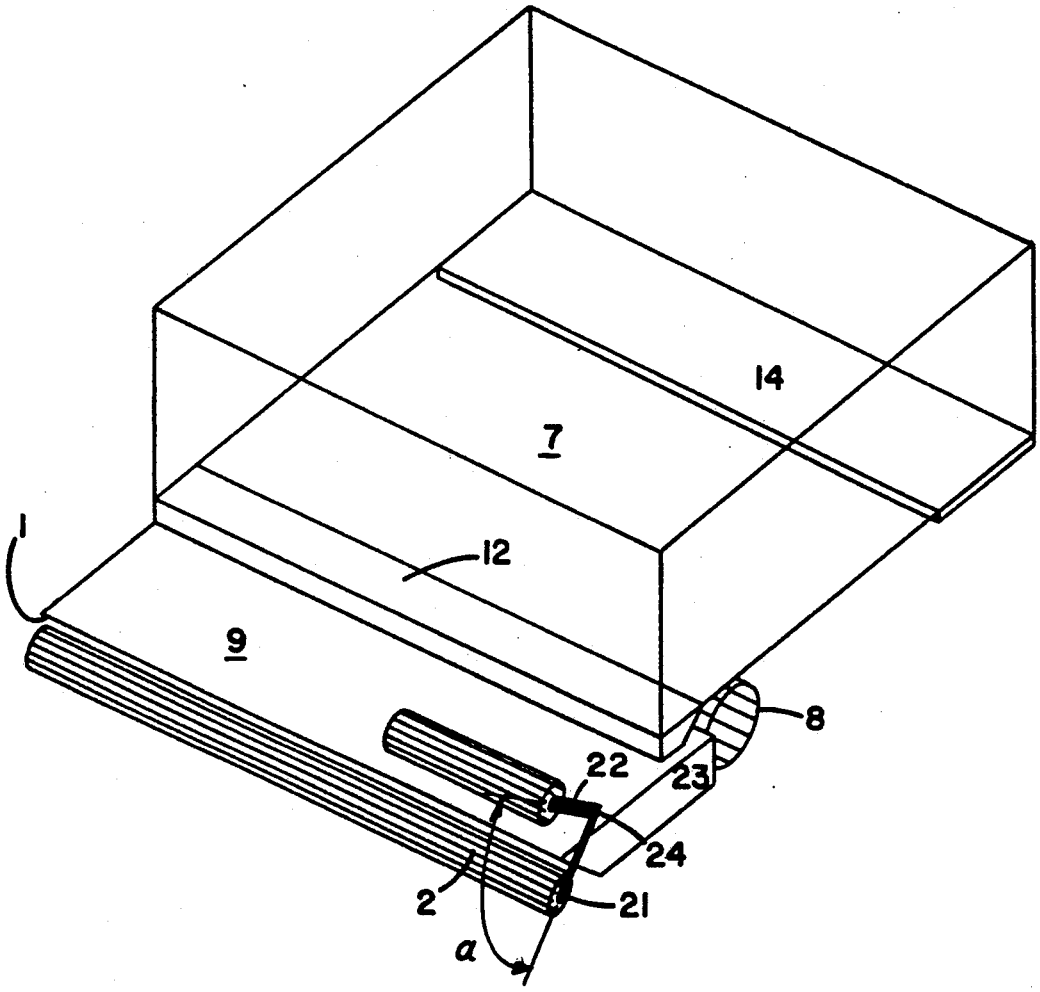
FIG. 1 shows an overall view of an automatic dispenser for label sheets with a stack holder.

FIG. 1 shows in perspective illustration the overall view of an exemplary embodiment of an automatic dispenser together with a corresponding stack holder 7. The bending edge 1 also forms the end of a support 9, on and along which the sheets 10 carrying the labels are advanced by a sheet feed device 8, after they have previously been removed by the sheet device 8 from the stack holder 7. The advance of a label sheet is effected continuously until the front edge of the sheet projects a certain amount beyond the bending edge 1. The length of this amount is dependent on how far the leading edge of the first label or of the first row of labels is spaced from the sheet edge Then, a pivotal or deflector roller 2, located above the sheet 10, in its upper position, is set in operation at this instant and is swung downwardly in an arc in front of the bending edge 1. To enable the desired pivotal movement, the pivotal roller 2, which is rotatable about an axis of rotation 21, is supported at its opposite ends in support arms 22. The pivotal roller 2 has an axial length which corresponds approximately to the length of the bending edge 1, and consequently thus to the width of a label sheet. The support arms 22 can thereby extend very simply as far as the lateral limit faces 23 of the support 9 and, in turn, can there be journalled on a pivot axis 24, which extends parallel to the bending edge 1.

The spacing between the pivot axis 24 and the axis of rotation 21 is so selected, taking into account the diameter of the pivotal roller 2 and the geometry of the support 9, that the pivotal roller 2, in its pivotal movement, is moved from its upper end position to its lower end position very close to the bending edge 1. In this manner, the pivotal roller can bend the leading edge of the label sheet, projecting beyond the bending edge 1 downwardly through more than 90° with respect to the major, plane of the label sheet, and since the individual rows of labels on the label sheet are separated from one another and from the unused label material forming the leading edge of the sheet, and the label sheet is initially shifted by the sheet feed device 8 in the sheet feed direction 8 only so far beyond the bending edge 1 that the leading edge of the first label row is located approximately in the region of the bending edge 1, after termination of the pivotal movement of the pivotal roller 2 and the associated actuation of the sheet teed device, the labels of the first row move further in the major plane of the label sheet, while the backing material of the label sheet is drawn downwardly around the bending edge 1 and beyond. The advance of the label sheet, with simultaneous drawing away of the backing material, is continued until the trailing edge of the first label row has almost reached the position of the bending edge 1. This is the position in which the individual labels of the first label row are successively manually removed from the dispenser and can be applied to the objects being labelled. Subsequently, the sheet feed device is again set in operation until the next row of labels has its trailing edges located shortly before the bending edge 1.

When, finally, the rear edge of the label sheet passes the sheet feed device 8, the next sheet in the stack holder 7 is directly engaged thereby and is fed directly after the leading sheet so that a continuous sequential supply, almost without lost time, is ensured. Between two sheets, then, there is required only a return pivotation of the pivotal roller into its upper end position.

Figure 2:
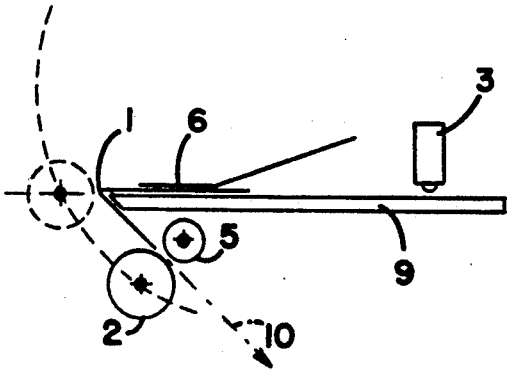
FIG. 2 shows a diagrammatic side view of the automatic dispenser according to a first embodiment.

FIG. 2 shows a schematic side view of the automatic dispenser. The pivot path of the pivotal roller 2, which is (partially) circularly-shaped in all exemplary embodiments, is also shown by a broken line. Furthermore, beneath the support 9 is shown a draw-off roller 5, against which the pivotal roller lies in its lower end position. On the support 9, furthermore, there is located a photoelectric sensor 3, which serves to detect the leading and trailing edges of the label sheets 10. The signals emitted by the photoelectric sensor can be then employed, for example, for the pivotation downwardly and backwardly of the pivotal roller 2, for controlling the draw-off roller 5 and the sheet feed device 8. The signal processing is suitably effected by a microprocessor. In addition, there is shown a hold-down device 6, which is arranged in a vicinity of the bending edge 1 of the support and which is intended to prevent bulging of the label sheets and to ensure secure guidance With corresponding adjustment of the hold-down force, it can then prevent, in particular, the rear sheet end from being turned up and in this way can prevent the partially released label from being creased or adhered to the pivotal roller. By means of the draw-off roller 5, reliable withdrawal of the backing paper of the labels is ensured, which backing paper, after the downward swinging of the pivotal roller 2, is clamped between this roller and the draw-off roller 5. However, it is clear that, for secure engagement of the sheet edge by the two rollers 2, 5, the spacing of the point of contact of these rollers from the bending edge 1 should not be greater than the spacing of the first label from the edge of the label sheet. The draw-off roller 5 has its own drive and can, like the pivotal roller 2, have a type of surface which serves to increase friction. Additionally, the draw-off roller 5 can be arranged so as to be movable in the direction of the bending edge by an adjustment device, not shown, so that the pivot path of the pivotal roller and, therewith, the bending angle are also limited, which can be advantageous, particularly for thicker or inflexible backing materials.

In the embodiment illustrated in FIG. 3, a sensor 4 is provided, which senses the leading edge of the label sheet, and also subsequently the leading edges of the label row in sequence and which can be included instead of, or in addition to, the photoelectric sensor 3. It may be a mechanical sensor or a further photoelectric sensor.

Figure 3:
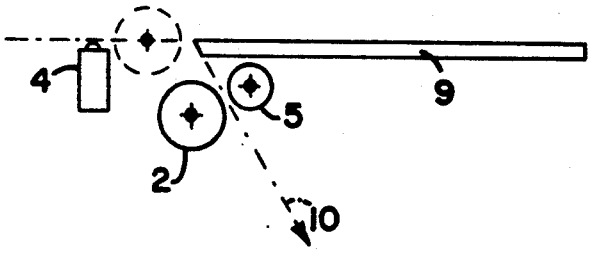
FIG. 3 shows a schematic side view of the automatic dispenser according to a second embodiment.

If only one sensor 4 is employed, as shown in FIG. 3, which is arranged beyond the bending edge, as viewed in the sheet feed direction, and registers only a leading sheet edge, then by means of an electric control unit, in which the spacing of the sensor from the bending edge, the spacing of the leading edge of a sheet from the leading edge of a label, the length of the label in the feed direction and the length of the sheet in the feed direction are stored, the further advance and the pivotal movement of the deflector roller can be controlled in dependence on this data.

If, in the above examples, a stepping motor driven by a microprocessor control is employed for driving each of the sheet feed device 8 and the draw-off roller 5, then the sensors of the device for initiating the operation can be completely omitted if the required data, i.e., thus, the sheet size and the sizes and spacing of the labels from the sheet edges, is registered by corresponding interfaces. In this case, also, a particularly easy adaptation of the automatic dispenser to different label sizes is possible.

The spacing between two successive sheets can be minimal. It must merely be ensured that the deflector device can be swung back from its lower end position, as shown in FIG. 1, into its upper end position before labels of the following sheet can be made ready. This can, for example, happen if the advance of the following sheet is somewhat delayed in order to provide room for the pivoting of the pivotal roller 2. Depending on the material, however, the pivotal roller 2 can also be moved from below upwardly when a not very large section of the following sheet is already located in the free space in front of the bending edge 1.

Figure 6:
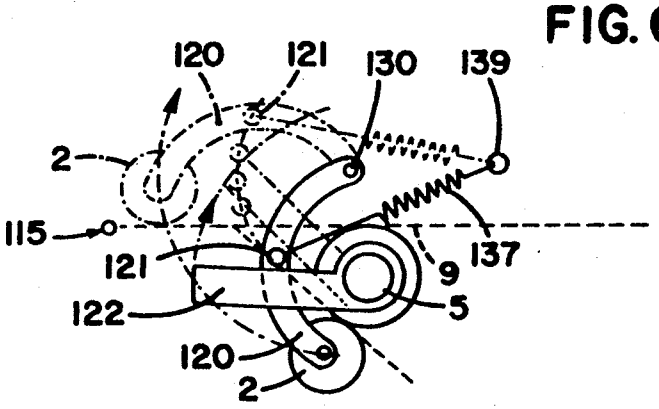
FIG. 6 shows a schematic side view according to arrow B in FIG. 4.
Figure 5:
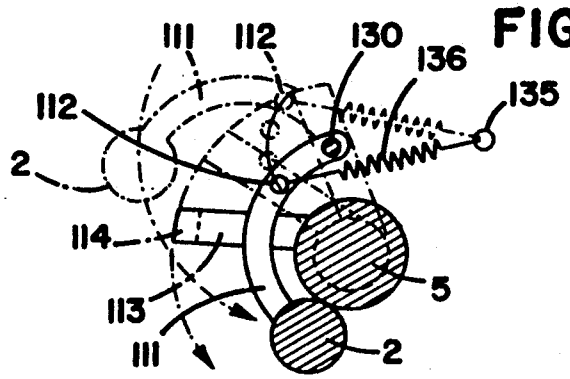
FIG. 5 shows a sectional view along the line A—A of FIG. 4.
Figure 4:
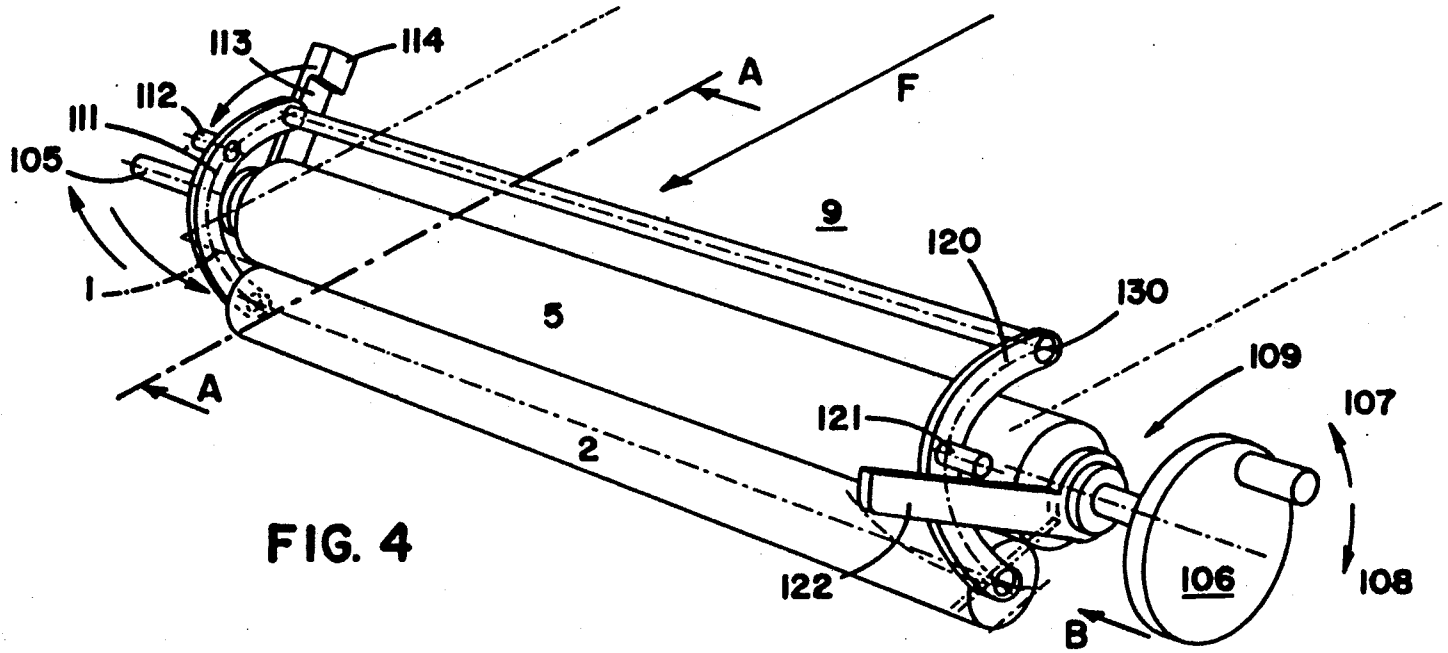
FIG. 4 shows a perspective illustration of a part of the automatic dispenser according to a fourth embodiment.

In FIGS. 4–6, there is shown a further embodiment of the invention, in which the control for the sheet feed device, the deflector device and the draw-off device is effected in a mechanical manner. In this embodiment, the sheet labels are removed from above from a stack standing in a magazine. Such magazines with sheet removal from the top are, for example, known from laser printers.

The draw-off device 5, in this embodiment, is formed by a roller with a shaft 105, on one end of which a hand wheel 106 is fixed for rotation therewith. The hand wheel can, advantageously, be fitted onto both ends of the shaft 105, so that the device can be used by left- and right-handed people. On the shaft 105, there is further located a drive wheel 109, by which the rotation of the shaft 105 is transferred through a cable or the like to a feed roller of a paper feed. With this paper feed device, upon rotation of the hand wheel 106 in the clockwise direction (direction of arrow 108 in FIG. 4), a sheet is removed from a magazine and advanced on the support 9 to the outlet region of the label dispenser (direction of arrow F in FIG. 4). By the rotation of the hand wheel 106 in this direction, furthermore, through a first drive member 122, which is located in the vicinity of one end surface of the draw-off roller 5 and mounted on the shaft 105, the deflector roller 2 is swung into its upper position, i.e. above the support 9. The deflector roller 2 is for that reason mounted at both ends in first and second arcuate support members (120, 111), the other ends of which, in the exemplary embodiment, are rotatably mounted on a shaft 130 fixed relative to the machine and extending above and parallel to the draw-off roller 5. Furthermore, at the first arcuate support members 120, there is provided a first pin 121, which cooperates with the first drive member 122 and makes possible the pivotal movement of the deflector roller in the opening direction. The stripper roller 5 may be arranged to rotate freely upon rotation of the hand wheel 106 in the clockwise direction. Between the advancing roller of the sheet feed device and the drive wheel 109, and also between the first drive member 122 and the shaft 105, there is provided a freewheel. If the hand wheel 106 is rotated at the direction of arrow 107, then the advancing roller and the first drive member 122 run freely. According to the adjustment of the friction of the first drive member 122 with the freewheel, this swings either downwardly under gravity or is also very easily driven, but then stops immediately on meeting an obstruction.

On rotation of the hand wheel 106 in the direction of arrow 107 shown in FIG. 4 (anti-clockwise), a second drive member 113, which is mounted in the vicinity of the other end surface of the draw-off roller 5 on the shaft 105 thereof, is driven in the same direction. This second drive member 113 has a projection 114, which cooperates with a second pin 112 fixed to the second arcuate support member 111, in such a manner that the projection 114 drives the second pin 112—even despite the different positions of the spaced axes of rotation—during its initial pivotal movement in the pivot direction and, on continued pivotal movement, slides over the second pin 112.

During the first part of its pivotal movement, the deflector roller 2 is pivoted by the second drive member 113 and then by a spring 136 (see FIGS. 5 and 6), from its upper position and drives the part of a sheet, located beyond the bending edge 1 in the feed direction, downwardly into contact with the draw-off roller 5. By the bending of the sheet labels about the bending edge 1, the labels are lifted, as described above, from the backing material and can then if required be completely withdrawn after further sheet feeding. If the draw-off roller 5 has a sufficiently small diameter, it can, if required, also fulfil the function of the bending edge.

The second drive member 113 is journalled on the shaft 105 with a freewheel therebetween. This freewheel is arranged so that, upon rotation of the hand wheel 106 in the direction of arrow 107, the abovedescribed pivotal movement of the second drive member 113 takes place. If the hand wheel 106 is rotated in the opposite direction (direction of arrow 108), then the free wheel ensures that the second drive member 113 is not driven by the shaft 105.

FIGS. 5 and 6 show in detail the co-operation and the movement of the first and second arcuate support members 120, 111 and the first and second drive members 122, 113. As shown in FIG. 5, on the second arcuate support members 111, advantageously in the vicinity of the second pin 112, there is secured one end of a first tension spring 136, which is not shown in FIG. 4. The other end of this tension spring is secured to a fixed pivot pin 135. The pivot pin of the first tension spring, and the pivot pin 130 of the arcuate support members are arranged relative to one another so that the deflector roller 2 is biassed by the first tension spring 136 into its upper and lower end position. This has the result that the deflector roller 3 must be swung by the projection 114 of the second drive member 113, from its upper position illustrated in broken lines in FIG. 5, only as far as beyond the dead point, at which the pivot pin of the first spring and the pivot of the arcuate support members lie in a common line. From this position, as already indicated, the further downward pivotation of the deflector roller 2 is effected by the force of the first spring 136.

The pivotation of the deflector roller from its lower position into the upper position is effected by the arrangement, shown in FIG. 6, of the first drive member 122, the first arcuate support member 120 and a second tension spring 137, which is not illustrated in FIG. 4. This second tension spring 137 is secured, furthermore, at one end to the first arcuate support member 120 in the vicinity of the first pin 121 and, at the other end, to a (further) pivot pin 139 fixed to the machine. The position of the pivot pin and of the pivot pins of the first arcuate support members are also selected here that the deflector roller 2 is biased into its two end positions. The pivotation of the deflector roller 2 from its lower position illustrated with solid lines, is effected by rotating the hand roller 106 in the direction of arrow 108 shown in FIG. 4, and thereby, the first drive member 122 swings the deflector roller 2, by means of the first pin 121, at least as far beyond the dead point as from where the further movement is effected by the force of the tension spring. The first drive member 122, in this embodiment, has no projection 114, but acts with substantially its entire narrow side, facing the first pin 121, on the latter.

In FIG. 6, furthermore, the support 9 is shown in dashed lines, which ends at the bending edge 1. In addition, a mark 115 is indicated, which represents how far a sheet should be advanced before the deflector roller 2 is swung downwardly.

It is particularly advantageous in this embodiment that no lavish and costly electronic control is required. The entire control is effected, moreover, by rotation of the hand wheel 106, firstly in the clockwise direction, until the leading edge of a sheet has been advanced into the outlet region, and by subsequent rotation of the hand wheel in the opposite direction, whereby the sheet is bent and is further advanced so that the labels adhered to it can be removed.

I claim:

1. A label dispenser for self-adhesive labels arranged on separate sheets, with a stack holder for the sheets, characterized by a sheet feed device (8) for the sheets, which draws them from the stack holder (7) and advances them sequentially, with the labels upwardly, over a support (9) in a feed direction toward a bending edge (1);

a deflector device which, as viewed in the feed direction of the sheet, is movable immediately beyond the bending edge (1) downwardly from a position above the labels, taking with it a part of the sheet located beyond the bending edge, into contact with a draw-off device;

a drive for the draw-off device, which pulls the sheet in contact with it at an angle to said feed direction;

and a control for the sheet feed device (8), the deflector device (2) and the draw-off device (5) such that each sheet lying on the support (9) is firstly advanced with its leading edge so far beyond the bending edge (1) that the leading edge of the first label or of the first row of labels is located in the vicinity of the bending edge (1), that the deflector device (2) is then actuated and subsequently the draw-off device (5) feeds the sheet transferred to it to release and advance the first label or the first row of labels beyond the bending edge until the trailing label edge is located substantially in the vicinity of the bending edge (1), then interrupts the further withdrawal until the removal of the label or all of the labels of the first row and continues the feeding and the withdrawal of each sheet in steps, corresponding to the first label or the first row of labels, as far as the last label or the last row of labels on each sheet.

2. A label dispenser according to claim 1, characterized in that the deflector device has a pivotal roller (2), which is pivotally mounted on the support (9) at both sides of the feed path of the sheets in support arms (22), is swingable through an angle $\alpha$ (FIG. 1) from an upper end position into a lower end position and back, and in that the pivot axis (24) of the pivotal roller as viewed in the feed direction of the sheet (10), is located before the bending edge (1) and extends parallel thereto.

3. A label dispenser according to claim 1, characterized in that the drive of the draw-off device is formed of a drive-off roller (5), which extends over the width of the sheet (10) to be conveyed, beneath the support (9) and is so arranged that the deflected sheets (10), which are to be withdrawn, are pressed by the pivotal roller (2) against the draw-off roller (5).

4. A label dispenser according to claim 1, characterized in that the control has a photoelectric cell (3), which, as viewed in the feed direction of the sheets (10), is located before the bending edge (1) and which responds to a passing sheet edge.

5. A label dispenser according to claim 1, characterized by a sensor (4), which as viewed in the feed direction of the sheet is arranged beyond the bending edge (1) and which detects a leading edge of a label sheet, and also by a device for registering, evaluating and further controlling the advance in dependence on the position and the size of the labels and of the sheets.

6. A label dispenser according to claim 5, characterized in that the stack holder (7) receives the label sheets (10) to be processed, which are stored flat, and has an upper opening corresponding to the size of the label sheets and, at its underside, an opening which extends in the feed direction and which is somewhat reduced with respect to the sheet size, but the width of which corresponds to the width of the sheets, and in that the sheet feed device (8) is arranged beneath the lower opening of the stack holder (7) in contact with sheets located therein and can be driven in opposite directions of rotation for withdrawing each sheet.

7. A label dispenser according to claim 5, characterized in that the deflector device, implemented as a pivotal or deflector roller, and the draw-off device, implemented as a draw-off roller, are controlled by rotation of a shaft carrying the draw-off roller (5), and in particular in such a way that by rotation in one direction, a sheet is removed from a supply stack and advanced to the outlet region of the label dispenser by the sheet feed device, and that, by rotation in the opposite direction, the deflector roller (2) is swung downwardly, taking with it the leading edge of the advanced sheet.

8. A label dispenser according to claim 7, characterized in that, by the rotary movement of the shaft (105) effecting the sheet advance, the deflector- or pivotal roller (2) is moved into its end position located above the bending edge.

9. A label dispenser according to claim 8, characterized by a first drive member and a second drive member (122, 113), which are connected to the shaft (105) so as to be fixed for rotation therewith in at least one direction and which effect the pivotal movements of the deflector roller (2).

10. A label dispenser according to claim 9, characterized by resilient biassing elements (136, 137) for alternatively biassing the deflector roller (2) into its two end positions.

11. A label dispenser according to claim 10, characterized in that the deflector roller (2) is held at both ends by a first arcuate support member and a second arcuate support member (120, 111), the other ends of which are rotatably mounted on a shaft (130) which is fixed relative to the machine and extends parallel to the draw-off roller (5).

12. A label dispenser according to claims 11, characterized in that the first arcuate support member (120) has a first pin (121) and the second arcuate support member (111) has a second pin (112), the second pin (112) co-operating in the upper position of the deflector roller (2) with a projection (114) on the second drive member (113) and the first pin (121) cooperating with the first drive member (122) in order to effect the pivotal movement of the deflector roller (2) from its upper position to its lower position and vice versa.

13. A label dispenser according to claim 12, characterized in that the first drive member and the second drive member (122, 113) are each connected by a freewheel with the shaft (105) in such a manner in that the second drive member (113) is pivotable by a rotary movement of the shaft only in the direction provided for the downward swinging of the deflector roller (2) and the first drive member (122) is swingable only in the direction provided for the upward pivotation of the deflector roller (2) and the drive members cannot be driven in the respective other directions.

14. A label dispenser according to claim 13, characterized in that, by the rotation of the shaft (105) in the direction which effects an upward pivotation of deflector roller (2), a drive wheel (109), for a feed roller in the sheet feed device is driven and it is driven through a separate freewheel for feeding a sheet, and in that the feed roller is stationary upon rotation of the shaft (105) in the opposite direction.

* * * * *